United States Patent [19]

Diggle

[11] Patent Number: 4,499,954

[45] Date of Patent: Feb. 19, 1985

[54] GEOTECHNICAL CONE LUBRICATION APPARATUS AND METHOD

[76] Inventor: Dennis A. Diggle, 12983 - 80th Ave., Surrey, British Columbia, Canada

[21] Appl. No.: 513,025

[22] Filed: Jul. 12, 1983

[51] Int. Cl.[3] ..... F21B 11/02

[52] U.S. Cl. ..... 175/21; 73/84; 405/248

[58] Field of Search ..... 175/21, 19; 73/84, 85; 405/248

[56] References Cited

U.S. PATENT DOCUMENTS

| | | | |
|---|---|---|---|
| 70,764 | 11/1867 | Wagner | 175/19 |
| 95,878 | 10/1869 | Brummel | 175/21 |
| 102,647 | 5/1870 | Ayres | 175/19 |
| 735,769 | 8/1903 | Higgins | 175/418 |
| 2,107,495 | 2/1938 | Otto | 105/201 |
| 2,129,978 | 9/1938 | Yokoyama | 405/248 |
| 3,040,810 | 6/1962 | Muller | 166/285 |
| 3,084,553 | 4/1963 | Cullinan | 73/804.31 |
| 3,397,542 | 8/1968 | Moulden | 405/266 |
| 4,359,890 | 11/1982 | Coelus | 73/12 |
| 4,382,384 | 5/1983 | Mitchell | 73/574 |

FOREIGN PATENT DOCUMENTS

| | | | |
|---|---|---|---|
| 256759 | 8/1948 | Switzerland | 73/84 |
| 218504 | 8/1968 | U.S.S.R. | 73/84 |
| 953086 | 8/1982 | U.S.S.R. | 73/84 |

*Primary Examiner*—Stephen J. Novosad
*Assistant Examiner*—Thuy M. Bui
*Attorney, Agent, or Firm*—Carver & Co.

[57] ABSTRACT

Apparatus and method for lubricating a string of hollow rods connected to a cone penetrometer within a probe hole, as used in geotechnical "in situ" testing. The rods have aligned bores to receive a drilling or lubricating fluid which passes along the rods to a perforated lubricating apparatus extending between an inner end of the string of rods and the cone penetrometer. Preferably a major portion of an outer surface of the lubricating apparatus is within a maximum cross-section of the cone penetrometer. A longitudinal bore within the lubricating apparatus communicates with a plurality of lubricating openings in the outer surface of the lubricating apparatus body. Thus lubricating fluid within the string of rods passes in to the longitudinal bore of the body and is dispersed through the plurality of the lubricating openings to the outer surface of the body, so as to stabilize side wall of the probe hole and to lubricate the string of drill rods within the probe hole.

10 Claims, 5 Drawing Figures

GEOTECHNICAL CONE LUBRICATION APPARATUS AND METHOD

BACKGROUND OF THE INVENTION

1. Field of the Invention

The invention relates to a lubricating apparatus and method for lubricating a string of hollow rods connected to a cone penetrometer as used in geotechnical "in situ" testing.

2. Prior Art

Cone penetrometers have been used for several decades for assessing properties of penetrable ground such as sand, silt, and other relatively soft overburden that can be penetrated without using drilling techniques. There are two main types of cone penetrometers, namely a dynamic type using "standard" hammer blows, and a static type using a steady push to produce a constant rate of penetration. The static type has been modernized and an electric type is available. The electric cone penetrometer, which is also known as the Dutch cone or the Fugro cone, has an elongated cylindrical body, about 1.5 meters long, and has a conical outer end containing transducers for measuring properties of the overburden such as end bearing loads or penetration resistance, skin friction, and pore pressure. The transducers provide signals which are transmitted either as electrical signals along wires in aligned bores of the rods, or as ultrasonic signals along the string of rods to a recording device positioned usually above the surface.

The static cone is pushed through the overburden using a force generator, such as a hydraulic ram system, which is designed to produce an essentially constant rate of penetration through the overburden to produce a probe hole. The cone penetrometer can have an enlarged portion which has a diameter slightly greater than that of the rods pushing the penetrometer, to reduce affect of the rods on the penetration force. However, usually the side wall of the probe hole moves inwards and the rods buckle slightly under the force and can drag on the side wall or inside of the probe hole, and the resulting drag limits depth of penetration of the cone penetrometer, usually to about thirteen to fifteen meters below the surface. This limit is reached in relatively soft ground, when using a ten ton deadweight as a reaction to the force generator and clearly a shallower limit is reached in overburden that is more difficult to penetrate. It is considered that this limitation of penetration is almost entirely due to drag between the rods and the sides of the probe hole, which drag clearly increases as the length of rods increase. The drag is a combination of friction and lateral forces acting in the rod. Similarly a limit due to drag of the rods on the probe hole is reached when using the dynamic type of cone penetrometer.

SUMMARY OF THE INVENTION

The invention reduces difficulties and disadvantages of the prior art by providing an apparatus and method which reduces the effect of drag between the string of rods and the probe hole. The resulting reduction in drag increases depth of penetration many times over that which was previously attainable. This increase in depth of penetration is attained with a relatively simple apparatus, which can be fitted to an existing cone penetrometer and rod combination in which the rods have aligned bores of sufficient size to pass drilling fluid therethrough, and uses simple auxiliary equipment normally found at a geotechnical testing site. The drilling fluid reduces coeffiecient of friction between the rods and the probe hole, and also penetrates the side wall of the probe hole which stabilises the side wall of the probe hole against inwards movement which reduces effective pressure that the overburden exerts laterally on the rod.

A lubricating apparatus according to the invention is for lubricating a string of hollow rods connected to a cone penetrometer within a probe hole as used in geotechnical testing. The rods have aligned bores and the lubricating apparatus has an elongated tubular body. The body has the first and second end portions adapted to be connected to an inner end of the string of hollow rods and to the structure adjacent the cone penetrometer respectively. The body also has a longitudinal bore extending along the body to communicate at the first end portion with the bores of the hollow rods, and a plurality of lubricating openings extending from the longitudinal bore to an outer surface of the tubular body. Thus lubricating fluid within the string of rods passes into the longitudinal bore of the body and is distributed through the plurality of lubricating openings to the outer surface of the body. Preferably, a major portion of the outer surface of the body is adapted to be within a maximum cross-section of the cone penetrometer. Also, a plurality of projections extend from the body to be generally adjacent the maximum cross section of the cone penetrometer so as to roughen the sidewall of the probe hole.

A fluid coupling is fitted to an outer end of the string of rods, usually above the ground, the coupling having a delivery bore which communicates with the aligned bores of the rods and a drilling or lubricating fluid supply, such as common drilling "mud". The fluid coupling also has an outer end portion adapted to receive a driving force aligned with the string of drilling rods, so as to apply a longitudinal driving force to the cone penetrometer. Thus, fluid passing through the fluid coupling and along the string of rods is distributed through the plurality of openings in the body to pass into the side wall of the probe hole to stabilize the probe hole and to lubricate the outer surface of the body and the string of rods within the probe hole as the cone penetrometer penetrates the overburden. By permitting the lubricating fluid to pass through openings of the lubricating apparatus to stabilize the side wall of the probe hole, and to lubricate the string of rods, drag of the rods within the probe hole is reduced with a negligible effect on readings of the cone penetrometer. To reduce chances of erosion of the probe hole, the volume of lubricating fluid used in the present invention is relatively low when compared with that used in rotary percussive drilling to remove cuttings, or in a hydraulic drill or wash boring where high pressure fluid is used to advance the bore holes.

A detailed disclosure following, related to drawings, describes a preferred embodiment of the invention which is capable of expression in apparatus and method other than those particularly described and illustrated.

DETAILED DISCLOSURE

FIG. 1

Figure 1:
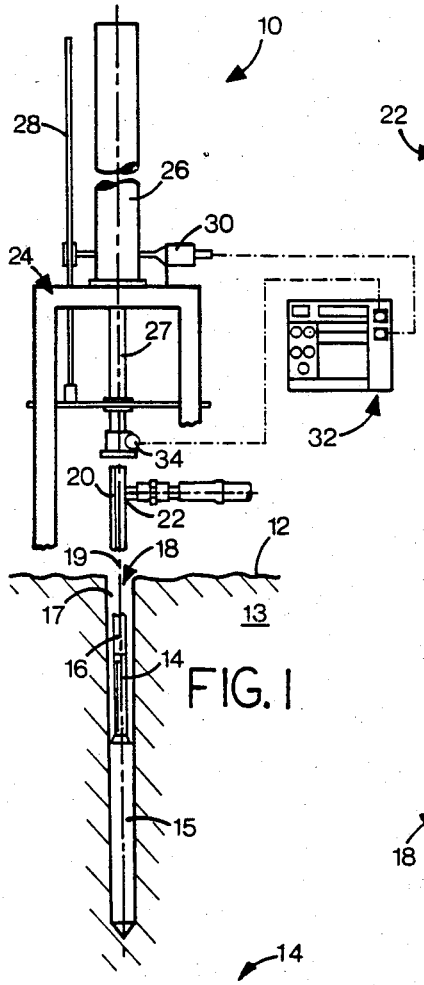
FIG. 1 is a simplified, fragmented diagram showing an electric cone penetrometer and a string or rods within a probe hole, and associated structure above ground.

A geotechnical "in situ" testing apparatus 10 according to the invention is shown supported on the ground, i.e. on the surface 12 of overburden 13 which is sufficiently soft to permit penetration by the cone penetrometer. A prior art electric cone penetrometer 15 and a lubricating apparatus 14 according to the invention are shown within a probe hole 17 and connected to an inner or lower end 16 of a string of hollow rods 18, which commonly have a 3 cm outer diameter and a central bore of about 2 cm diameter. The string of rods has an axis 19 and an upper or outer end 20 having a fluid coupling 22 above the surface 12 to receive a supply of lubricating fluid, also known as drilling fluid or "mud" along a supply conduit 23. The penetrometer is of the previously described type in which bores of the rods are not obstructed significantly with electrical wires etc, so as not to impede fluid flow to the penetrometer. The "mud" is that as used in drilling and is typically a suspension of Bentonite in water with other additives as is well known. In drilling, this "mud" is used to cool the drill bit and to remove cuttings from the drill bit which pass out of the borehole, by passing along the clearance between the borehole and the drill rods. The drilling fluid also penetrates the side wall of the drill hole and stabilizes the side wall against inward movement and thus reduces pressure of the overburden on the drill rods. To the inventor's knowledge, this "mud" is not used in geotechnical cone penetrometer techniques, and the use of this mud mixture or a similar or equivalent drilling fluid is essential to the present invention.

A ram support structure 24, which is weighted to react against penetration force, carries a hydraulic, double-acting ram 26 which has a piston rod 27 adapted to engage the coupling 22, as will be described with reference to FIG. 2. A depth synchronization rod 28 is connected to the ram 27 and a pulse generator 30, cooperating with the rod 28, feeds a pulsed signal to a recording unit 32 to provide an accurate indication of the depth of penetration of the penetrometer. A microphone 34, fitted adjacent to the ram 27, receives signals from the string of rods 18, which signals are transferred to the recording unit for recording and interpretation. With the exception of the lubricating apparatus 14, the fluid coupling 22 and the lubricant supply conduit 23, the geotechnical testing apparatus 10 as above described is well known. The electric cone penetrometer transmits signals from the transducers adjacent to the conical tip thereof which reflect pore pressure, loading and/or skin friction as required.

Figure 2:
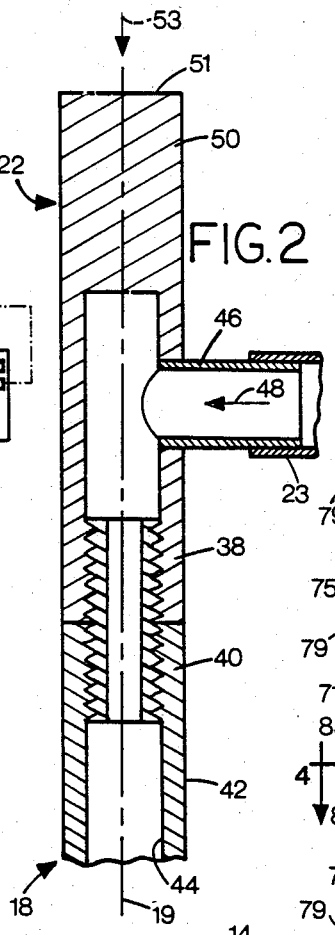
FIG. 2 is a simplified, fragmented, longitudinal section of an outer or upper end of the string of rods above ground showing a fluid coupling means associated with the invention.
Figure 3:
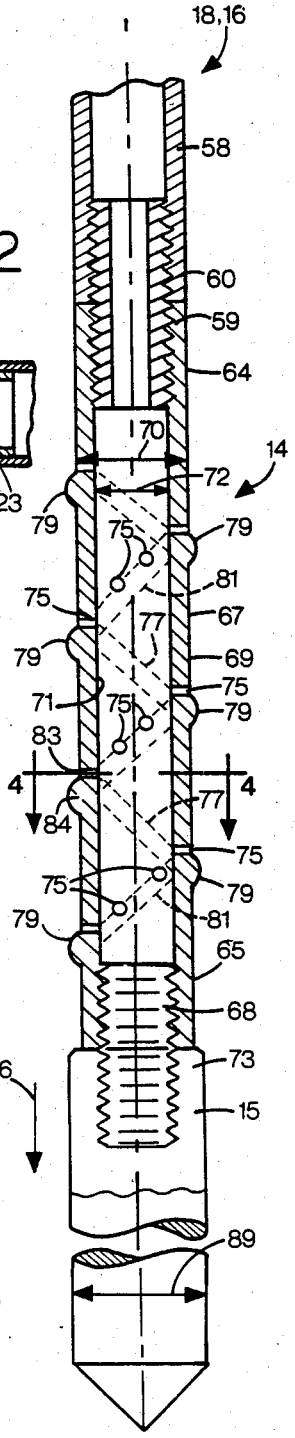
FIG. 3 is a simplified, fragmented, partially longitudinal section of an inner or lower end of a string of rods, adjacent to the cone penetrometer within the probe hole.

FIGS. 2 and 3

Referring to FIG. 2, the fluid coupling 22 is adapted to be fitted by a hollow threaded coupling 38 to an outer end 40 of an upper rod 42 of the string of rods 18. The outer end 40 has a conventional female thread to receive the threaded coupling 38, and the upper rod 42 has a longitudinal bore 44 which communicates with the fluid coupling through the hollow coupling 38. The fluid coupling 22 has an intake pipe 46 connected to the conduit 23 leading to a low pressure lubricant pump, not shown, to receive lubricating fluid in direction of an arrow 48. The coupling 22 has an outer end portion 50 having a face 51 to receive a driving force aligned with the axis 19 of the string of rods, the force being applied in direction of an arrow 53 when driving the rods, which force can be reversed when pulling the rods and penetrometer from the probe hole.

Referring to FIG. 3, the inner or lower end 16 of the string of rods 18 has a lower rod 58 having a lower end 60 with a hollow threaded connector 59 fitted therein. The lubricating apparatus 14 according to the invention has an elongated tubular body 67 having first and second end portions 64 and 65 respectively, connected to the inner end 16 and the cone penetrometer 15 respectively, i.e. the apparatus 14 is disposed between the string of rods and the penetrometer 15. The body 67 has a cylindrical outer surface 69 and a longitudinal bore 71 extending along the body to communicate at the first end portion of the body with the aligned bores of the string of rods 18. As previously stated, the penetrometer 15 is a conventional prior art electric penetrometer, and has a female threaded upper end 73 which receives a threaded coupling 68 which is connected to the second end portion 65 of the body, whereas in the prior art structure the end 73 would normally be connected directly to the lower end 16 of the string of rods. The apparatus 14 has an outer diameter 70 of about 3 cm, and the bore 71 has a diameter 72 of about 2 cm so as to be compatible with the size of the aligned rods. The body is about 20 cm long and a plurality of lubricating openings 75 extend from the longitudinal bore 71 to the outer surface 69 of the tubular body. The openings are preferably between about 1 and 4 mm in diameter and are spaced apart between 1 and 4 cm, although a wide variation in size and spacing is acceptable. The plurality of lubricating openings are disposed generally equally between the first and second end portions of the body, and are preferably disposed upon a theoretical helix 77 shown in broken outline extending between the first and second end portions. In other words, the plurality of lubricating openings are disposed helically about the body, and the helix extends over a length of about 15 cm.

A plurality of projections 79 extend from the body and are similarly disposed on a theoretical helix 81, which is preferably similar to the helix 77, so that each projection is disposed closely adjacent to a respective opening. Considering one particular projection 84 which is positioned near a particular opening 83, the projection 84 is positioned on a side of the opening 83 remote from the first end portion to which the string of rods connected. That is, the projections are positioned on the body on a side of the respective openings adjacent the penetrometer, which is "upstream" of a particular opening when considering the direction of penetration of the penetrometer, shown as an arrow 86.

Figure 4:
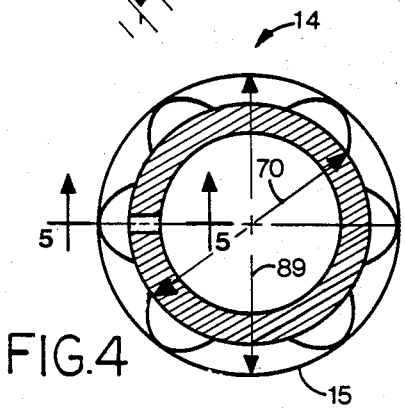
FIG. 4 is a simplified transverse section on line 4—4 of FIG. 3, drawn at a larger scale.
Figure 5:
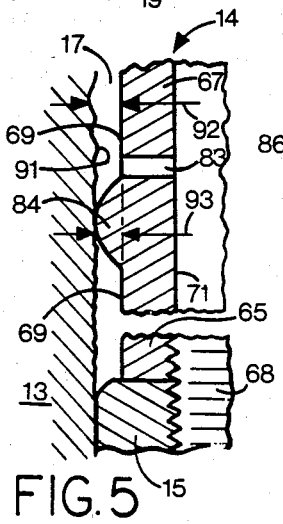
FIG. 5 is a simplified fragmented section on line 5—5 of FIG. 4, drawn at a larger scale than FIG. 4, and showing adjacent portions of the probe hole.

FIGS. 4 and 5

As previously stated, the body 67 has a circular cross-section, and the diameter 70 thereof is less than a maximum diameter 89 of the penetrometer. Thus, as the penetrometer produces the probe hole 17, a side wall of which is designated in 91 in FIG. 5, the surface 69 is spaced from the side wall 91, which provides a clearance 92 for fluid flowing though the opening 84 and for the string of rods 18. The clearance 92 is about 1.6 mm for the nominal sizes of common rods and penetrometer. The projection 83 need not be positioned to be within the maximum diameter of the cone penetrometer, and can project from the cylindrical surface 69 a distance 93 which can be about 3.0 mm maximum, although this is not critical. The projections 79 can be made by touching the surface 60 with a welding electrode, and this is necessarily inexact and a wide variation in projection sizes can be accomodated. The projections, which can be partially spherical, can vary in size between 2 mm and 8 mm in diameter as displayed on the surface 69, and can project from the cylindrical surface a distance of between 1 mm and 3 mm approximately. The projections extend from the body to be generally adjacent the maximum cross-section of the penetrometer and are designed to scrape the surface 91 of the probe hole which can have a tendency to move inwardly after passage of the cone penetrometer. The scraping is considered to roughen the surface of the probe hole in certain soil conditions, which facilitates the penetration of the lubricating mud into the surface of the probe hole, so as to reduce overall drag by reducing the coeffecient of friction and effective pressure or lateral stress on the rods as the cone penetrates into the overburden. Also, the projections are positioned closely adjacent to, and upstream of, a respective lubricating opening so that the chance of the dirt from the probe hole blocking the lubricating opening is reduced.

OPERATION

Operation of the invention follows closely the normal procedure for geotechnical testing using the cone penetrometer with the exception that lubricating mud is supplied to the fluid coupling 22 by a low volume delivery pump. The cone penetrometer is pushed into the overburden in a series of essentially continuous strokes in direction of the arrow 86, the length of the strokes being limited by the ram characteristics and the length of the rods. The speed of penetration is typically about 2 cm per second, although a range of speed is permissible provided there is little variation within one particular series of strokes. It has been found that, in many common soil conditions tested such as glacial till and alluvial silt, there seems to be little tendency for the lubricating mud to move downwardly from the lubricating apparatus 14 to interfere with cone readings. To ascertain whether or not there is any downward penetration of lubricating mud to the cone itself, during some tests the penetration of the cone was stopped for up to half an hour, and the readings of the soil characteristics from the cone penetrometer were monitored continuously and there was no indication of change due to downward movement of the lubricating mud. Probably this is because the transducers in the cone itself are at least one meter below the lowest lubricating opening of the lubricating apparatus, and thus a considerable downward penetration of lubricating mud would be required before readings of the penetrometer cone were influenced.

It is well know in the trade that a limit of penetration of about 13 to 15 meters is usually attanined in average soft ground conditions using a ten ton dead weight for reaction for a hydraulic ram or equivalent with a non-lubricated prior art apparatus. Using the lubricating apparatus of the present invention in similar soil and weight conditions, the depth of penetration has been increased to approximately 100 meters and even at this depth there appears to be little increase in resistance to penetration. It should be noted that in these tests the cone could have been pushed further to extend deeper than 100 meters, but it was found that the signals from the transducers were becoming indistinct at such a distance, and the testing was terminated due to inadequate signals. It is considered that with the improvements in transducers and transmitter technology, the depth of penetration could exceed 150 to 200 meters using the lubrication apparatus and method of the invention.

It is also noted that the volume of lubricating fluid used is considerably less than that used in conventional drilling because there is essentially no removal of material displaced by the penetrometer. In fact, after a few meters of penetration there is usually no return of lubricating fluid to the surface, which contrasts with normal drilling practice. For example, between 2 and 4 liters per meter of cone penetration is typical, compared with tens of liters per meter when using conventional drilling methods. This is attained by having the openings of a size and number, and the lubricating fluid of a pressure and volume flow such that fluid flow through the openings produces negligible erosion of the probe hole, although this is not essential.

In summary, the method of the invention includes passing a lubricating fluid along aligned communicating bores of a string of rods within a probe hole to a lubricating apparatus fitted to the string of rods adjacent to the cone penetrometer. The method is characterized by permitting the lubricating fluid to pass through openings of the lubricating apparatus to lubricated the string of rods, so as to reduce drag of the rods within the probe hole with a negligible effect on readings of the cone penetrometer. It is noted that the fluid volume passing through the openings 75 is sufficiently low to produce negligible erosion of the side wall of the probe hole.

ALTERNATIVES AND EQUIVALENTS

The invention is described for use with a lubricating apparatus in which the diameter of the lubricating apparatus is preferably no greater than the maximum diameter of the cone penetrometer. If the lubricating apparatus were very much larger in diameter than the cone penetrometer, a greater penetrating force would be required and this is usually undesirable. Preferably the lubricating apparatus is about the same diameter as the rods, or slightly less than the penetrometer to provide a clearance envelope surrounding the lubricating apparatus of about 1.6 mm. If desired, the invention can be provided with the plurality of projections which can extend from the surface of the lubricating apparatus to exceed an envelope defined by the maximum diameter of the cone penetrometer. However, the number and size of the projections is such that a major portion of the outer surface of the lubricating apparatus preferably is within a maximum cross-section of the cone penetrometer so as not to increase penetrating force. The projections can be omitted, or can be positioned in different locations other than those illustrated. Similarly, the helical disposition of openings and projections can be changed, although preferably there should be a generally relatively even distribution of fluid openings and projections around the lubricating apparatus. The first and second end portions 64 and 65 can be adapted to connect to the string of rods and the penetrometer respectively using means other than the threaded connections as shown. Also, a relatively short coupling could be fitted between the second end portion 65 and the penetrometer, but preferably the outer end portion 65 should be connected to structure closely adjacent the core penetrometer.

The invention as described relates specifically to an electric cone penetrometer, however it can be applied to a non-electric static type, or to a non-electric dynamic type using standardized hammer blows. For all types, preferably the lowest lubricating opening of the lubricating apparatus is no closer than about one meter from the lowermost portion of the cone, thus reducing the chances of lubricating fluid reaching the cone itself.

I claim:

1. A lubricating apparatus for lubricating a string of hollow rods connected to a cone penetrometer within a probe hole as used in geotechnical "in situ" testing, the rods having aligned bores communicating with each other and being of sufficient size to pass drilling fluid therethrough, the lubricating apparatus having an elongated tubular body characterized by:

(a) first and second end portions adapted to be connected to an inner end of the string of hollow rods and to structure adjacent the cone penetrometer respectively, (b) a longitudinal bore extending along the body and communicating at the first end portion of the body with the bores of the hollow rods, (c) a plurality of lubricating openings extending from the longitudinal bore to an outer surface of the tubular body, in which a major portion of the outer surface of the body is adapted to be within a maximum cross-section of the cone penetrometer, (d) a plurality of projections extending from the outer surface of the body so as to be generally adjacent the maximum cross-section of the cone penetrometer, so as to roughen the sidewall of the probe hole, so that drilling fluid within the string of rods passes into the longitudinal bore of the body and is distributed through the plurality of lubricating openings to the outer surface of the body, and passes into side wall of the probe hole to stabilize the probe hole.

2. An apparatus as claimed in claim 1 in which:

(a) the body has a circular cross-section having a diameter less than maximum diameter of the penetrometer.

3. An apparatus as claimed in claim 2 further including:

(a) at least one projection is positioned closely adjacent to one opening, on a side of the opening remote from the first end portion to which the string of rods is connected.

4. An apparatus as claimed in claim 3 in which:

(a) the plurality of openings are disposed helically about the body, (b) the plurality of projections are similarily disposed helically about the body, each projection being positioned closely adjacent to a respective opening, on a side of the respective opening remote from the first end to which the string of rods is connected.

5. An apparatus as claimed in claim 1 in which:

(a) the plurality of lubricating openings is disposed generally equally between the first and second end portions of the body, and are of such a size as to produce a fluid flow therethrough that produces a negligible erosion of the probe hole.

6. An apparatus as claimed in claim 1 in which:

(a) particular projections are positioned closely adjacent particular openings, in which each projection is disposed on a forward side of a respective opening remote from the first end portion of the lubricating apparatus to which the string of rods is connected.

7. A geotechnical testing assembly for assessing properties of overburden and the like adjacent a probe hole within the overburden, the assembly including a cone penetrometer and a string of hollow rods having aligned bores communicating with each other and being of sufficient size to pass drilling fluid therethrough, the assembly further including:

(a) a lubricating apparatus having an elongated tubular body having first and second end portions connected to an inner end of the string of hollow rods and structure adjacent the penetrometer respectively, (b) the body being characterized by: a longitudinal bore extending along the body to communicate at the first end of the body with the bores of the hollow rods, a plurality of lubricating openings extending from the longitudinal bore to the outer surface of the tubular body, a major portion of the outer surface of the tubular body being adapted to be within a maximum cross-section of the cone penetrometer, and a plurality of projections extending from the outer surface of the body so as to be generally adjacent the maximum cross-section of the cone penetrometer, (c) a fluid coupling adapted to be fitted to an outer end of the string of rods, the coupling having a delivery bore which communicates with the aligned bores of the rods and a drilling fluid supply, the fluid coupling also having an outer end portion adapted to receive a driving force aligned with the string of drilling rods, so as to apply a longitudinal driving force to the cone penetrometer, so that fluid passing through the fluid coupling and along the string of rods is distributed though the plurality of openings of the body to the outer surface of the body to lubricate the outer surface of the body and the string of rods within the probe hole as the cone penetrometer penetrates the overburden.

8. A method of lubricating a string of rods connected to a cone penetrometer within a probe hole in overburden as used in geotechnical "in situ" testing, the rods being hollow and having aligned bores of sufficient size to pass drilling fluid therethrough, a perforated lubricating apparatus being fitted to the string of rods adjacent to the cone penetrometer, the apparatus having openings communicating with the aligned bores, the method being characterized by:

(a) pushing the rods to drive the penetrometer through the overburden to produce the probe hole, (b) passing the drilling fluid along the aligned bores of the rods, (c) permitting the drilling fluid to pass through the openings of the lubricating apparatus to pass into the side wall of the probe hole so as to stabilize the probe hole and to lubricate the string of rods, so as to reduce drag on the rods within the probe hole with a negligible effect on readings of the cone penetrometer.

9. A method as claimed in claim 8 in which, (a) the lubricating fluid passes through the lubricating openings at a flow rate which produces negligible erosion of the probe hole.

10. A method as claimed in claim 8, in which the lubricating apparatus has projections extending therefrom, a particular projection being positioned on a forward side of a particular opening remote from an end of the apparatus to which the string of rods is connected, the method being further characterized by:

(a) as the penetrometer is pushed into the probe hole, scraping the side wall of the probe hole with the projections to roughen the side wall to facilitate penetration of the drilling fluid into the side wall.

* * * * *